US010041641B2

(12) United States Patent
Kim et al.

(10) Patent No.: US 10,041,641 B2
(45) Date of Patent: Aug. 7, 2018

(54) LED STREETLAMP

(71) Applicant: Jong Hui Kim, Suwon-si, Gyeonggi-do (KR)

(72) Inventors: Jong Hui Kim, Suwon-si Gyeonggi-do (KR); Jeung Min Park, Yongin-si Gyeonggi-do (KR)

(73) Assignee: Jong Hui Kim, Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/443,013

(22) Filed: Feb. 27, 2017

(65) Prior Publication Data

US 2017/0175962 A1 Jun. 22, 2017

Related U.S. Application Data

(63) Continuation of application No. PCT/KR2014/008275, filed on Sep. 3, 2014.

(30) Foreign Application Priority Data

Aug. 27, 2014 (KR) ..... 10-2014-0112178

(51) Int. Cl.
*F21V 1/00* (2006.01)
*F21V 11/00* (2015.01)
(Continued)

(52) U.S. Cl.
CPC ..... *F21S 8/086* (2013.01); *F21S 4/28* (2016.01); *F21V 5/04* (2013.01); *F21V 19/003* (2013.01);
(Continued)

(58) Field of Classification Search
CPC ..... F21S 8/086; F21S 4/28; F21V 31/005; F21V 19/003; F21V 29/83; F21V 29/67;
(Continued)

(56) References Cited

U.S. PATENT DOCUMENTS

2008/0080189 A1* 4/2008 Wang ..... F21S 8/086 362/294
2009/0016055 A1 1/2009 Liu et al.
(Continued)

FOREIGN PATENT DOCUMENTS

JP 3151288 5/2009
JP 3163564 9/2010
(Continued)

OTHER PUBLICATIONS

International Search Report for International Application PCT/KR2014/008275, dated May 18, 2015.

*Primary Examiner* — Anh Mai
*Assistant Examiner* — Glenn Zimmerman
(74) *Attorney, Agent, or Firm* — Burris Law, PLLC

(57) ABSTRACT

An LED streetlamp is provided that includes: a frame; a main PCB installed in the frame, extending in a longitudinal direction of the frame, and provided with a connector at a first side surface thereof; and a plurality of LED bars, each being coupled to the frame at an end thereof and emitting light by being powered by the main PCB, the LED bars symmetrically arranged with respect to the frame and arranged at regular intervals in the longitudinal direction of the frame.

7 Claims, 9 Drawing Sheets

(51) Int. Cl.

| | |
|---|---|
| ***F21S 8/08*** | (2006.01) |
| ***F21V 29/74*** | (2015.01) |
| ***F21V 5/04*** | (2006.01) |
| ***F21V 29/67*** | (2015.01) |
| ***F21V 29/83*** | (2015.01) |
| ***F21S 4/28*** | (2016.01) |
| ***F21V 19/00*** | (2006.01) |
| ***F21V 31/00*** | (2006.01) |
| *F21W 131/103* | (2006.01) |
| *F21Y 115/10* | (2016.01) |

(52) U.S. Cl.
CPC ..... *F21V 29/67* (2015.01); *F21V 29/74* (2015.01); *F21V 29/83* (2015.01); *F21V 31/005* (2013.01); *F21W 2131/103* (2013.01); *F21Y 2115/10* (2016.08)

(58) Field of Classification Search
CPC ..... F21V 5/04; F21V 29/74; F21Y 2115/10; F21W 2131/103
USPC ..... 362/235, 249.02, 249.14, 431, 236, 367
See application file for complete search history.

(56) References Cited

U.S. PATENT DOCUMENTS

| | | | | |
|---|---|---|---|---|
| 2009/0237930 | A1 | 9/2009 | Li | |
| 2012/0057357 | A1 | 3/2012 | Kim et al. | |
| 2013/0148340 | A1 | 6/2013 | Shen | |
| 2014/0226305 | A1* | 8/2014 | Kim | F21S 2/00 362/84 |
| 2015/0276152 | A1* | 10/2015 | Su | F21K 9/56 362/84 |

FOREIGN PATENT DOCUMENTS

| | | |
|---|---|---|
| JP | 2011197028 | 10/2011 |
| JP | 2014154637 | 8/2014 |
| KR | 100984768 | 9/2010 |
| KR | 1020100131773 | 12/2010 |
| KR | 101033008 | 5/2011 |
| KR | 1020110060476 | 6/2011 |
| WO | 2011070724 | 6/2011 |

* cited by examiner

[FIG. 1]
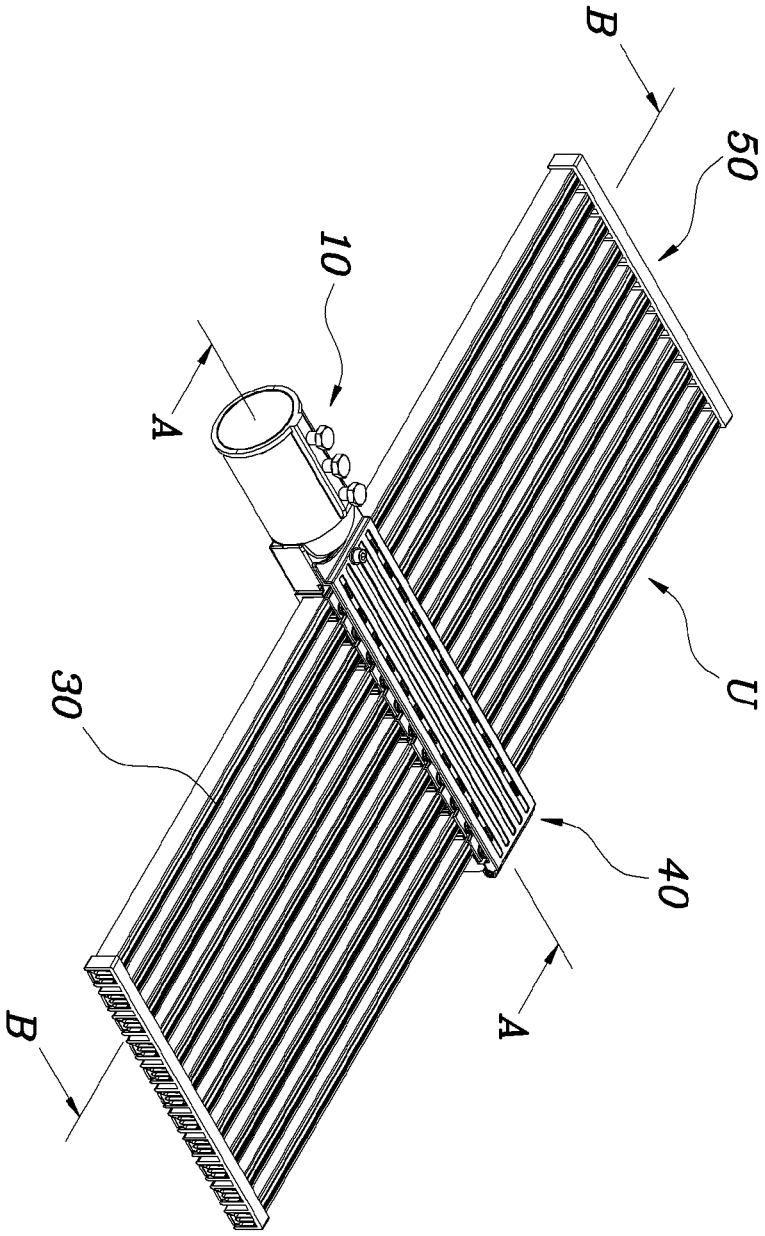

[FIG. 2]
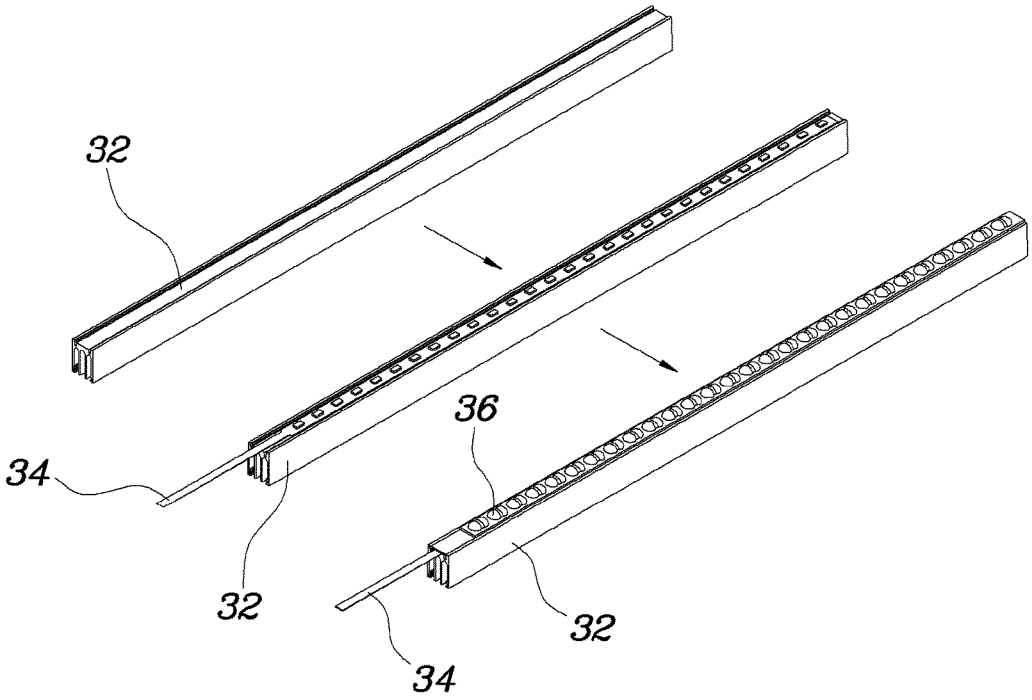

[FIG. 3]
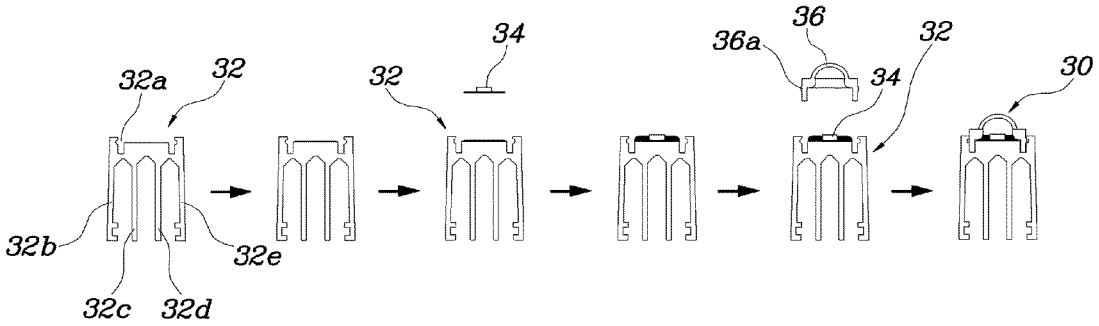

[FIG. 4]
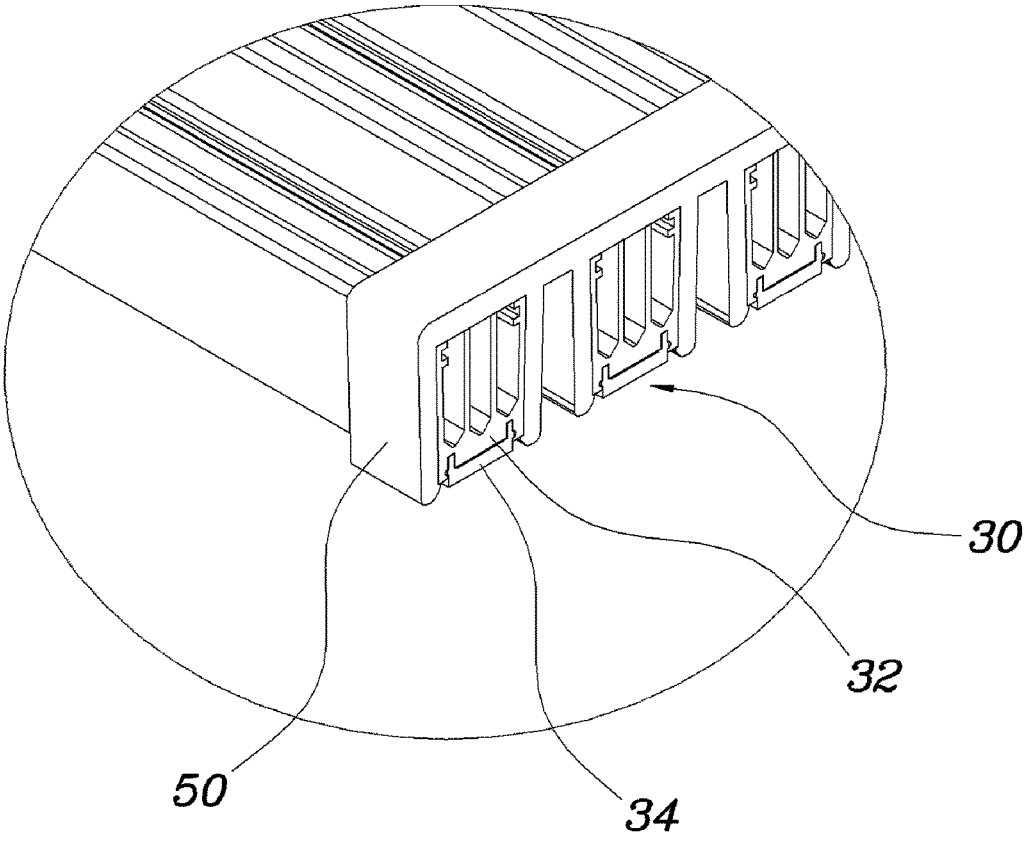

[FIG. 5]
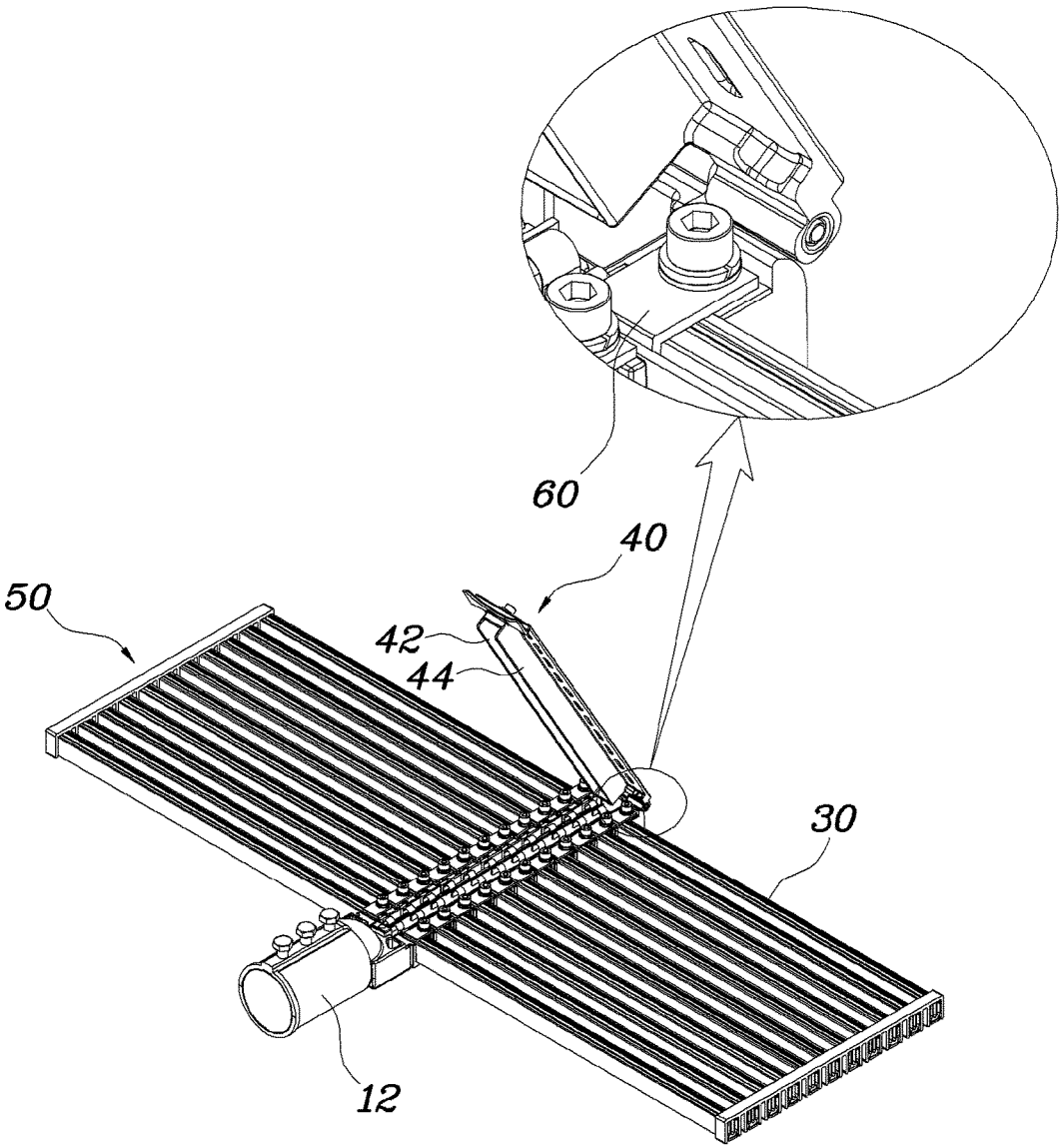

[FIG. 6]
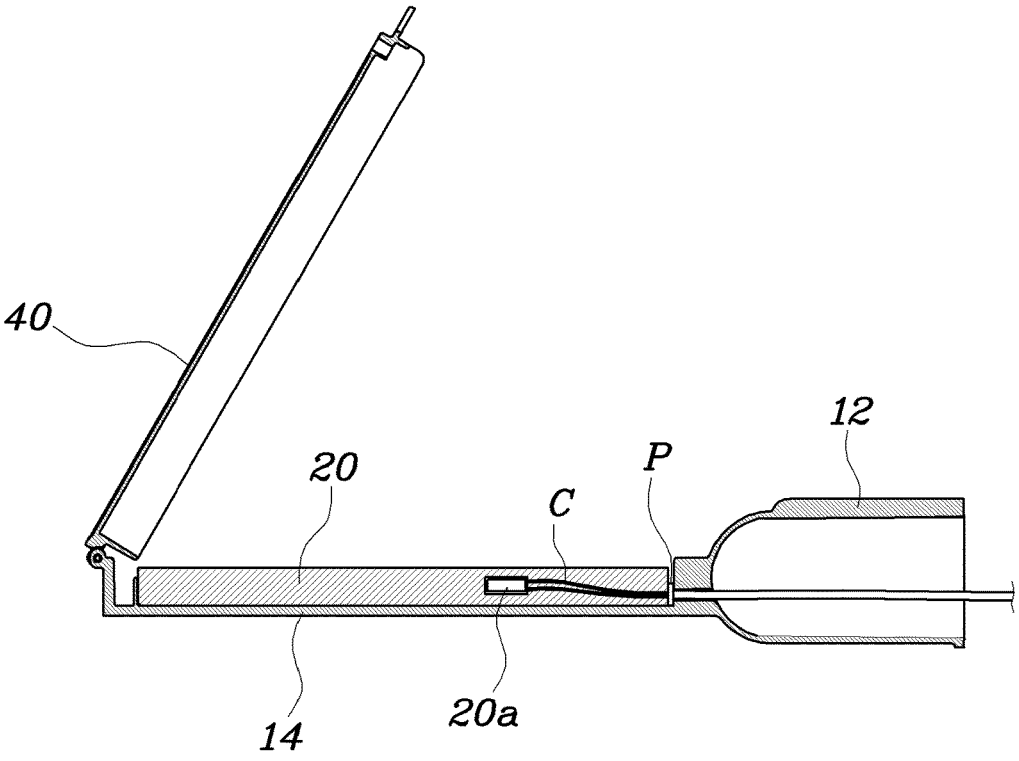

[FIG. 7a]
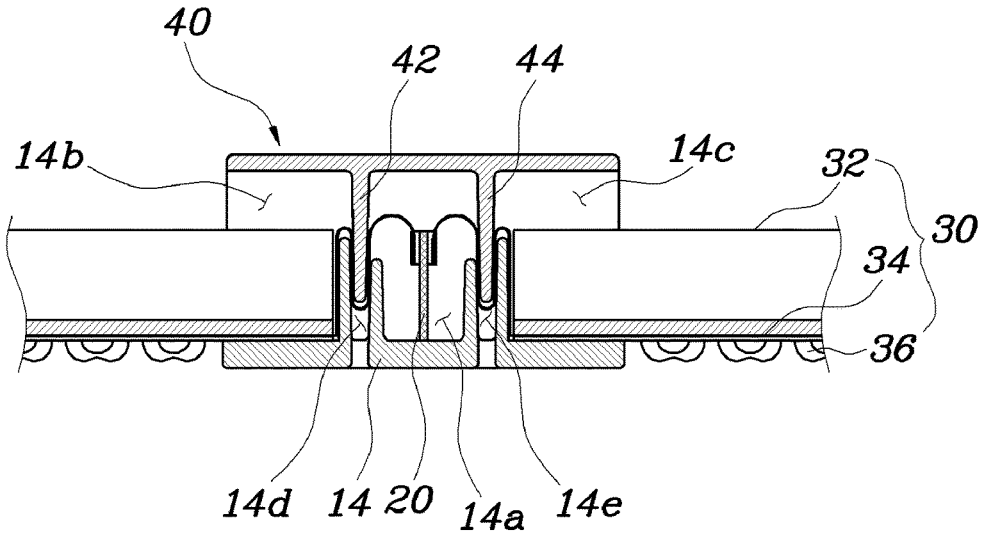

[FIG. 7b]
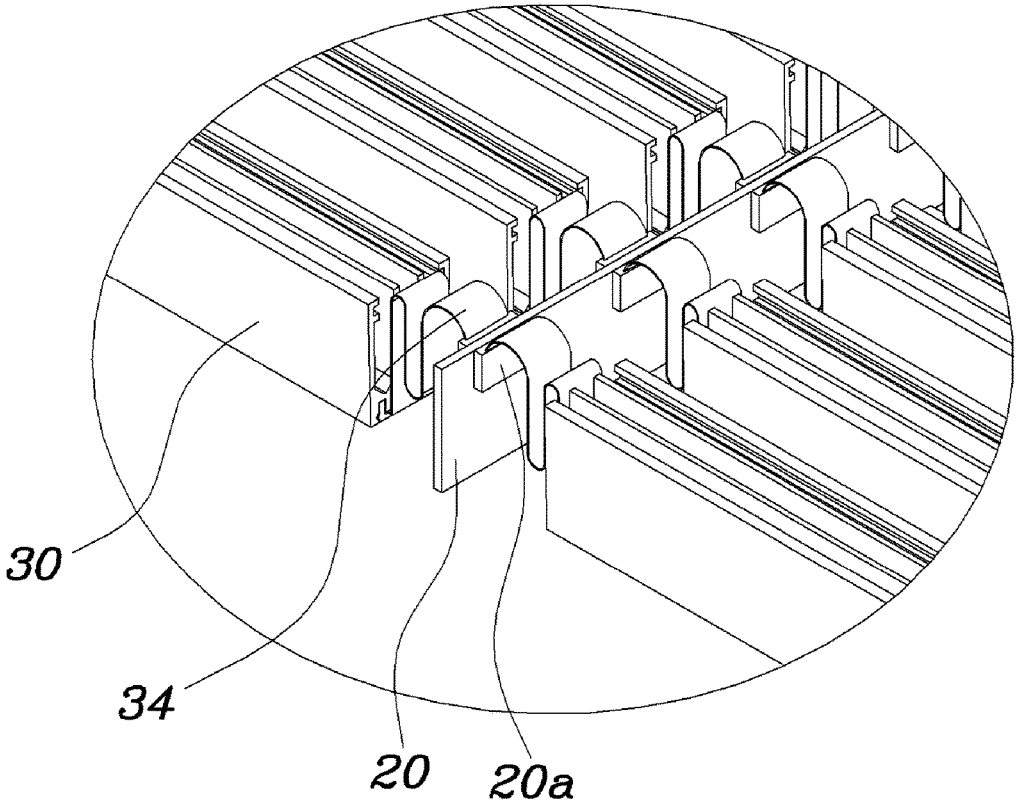

[FIG. 8]
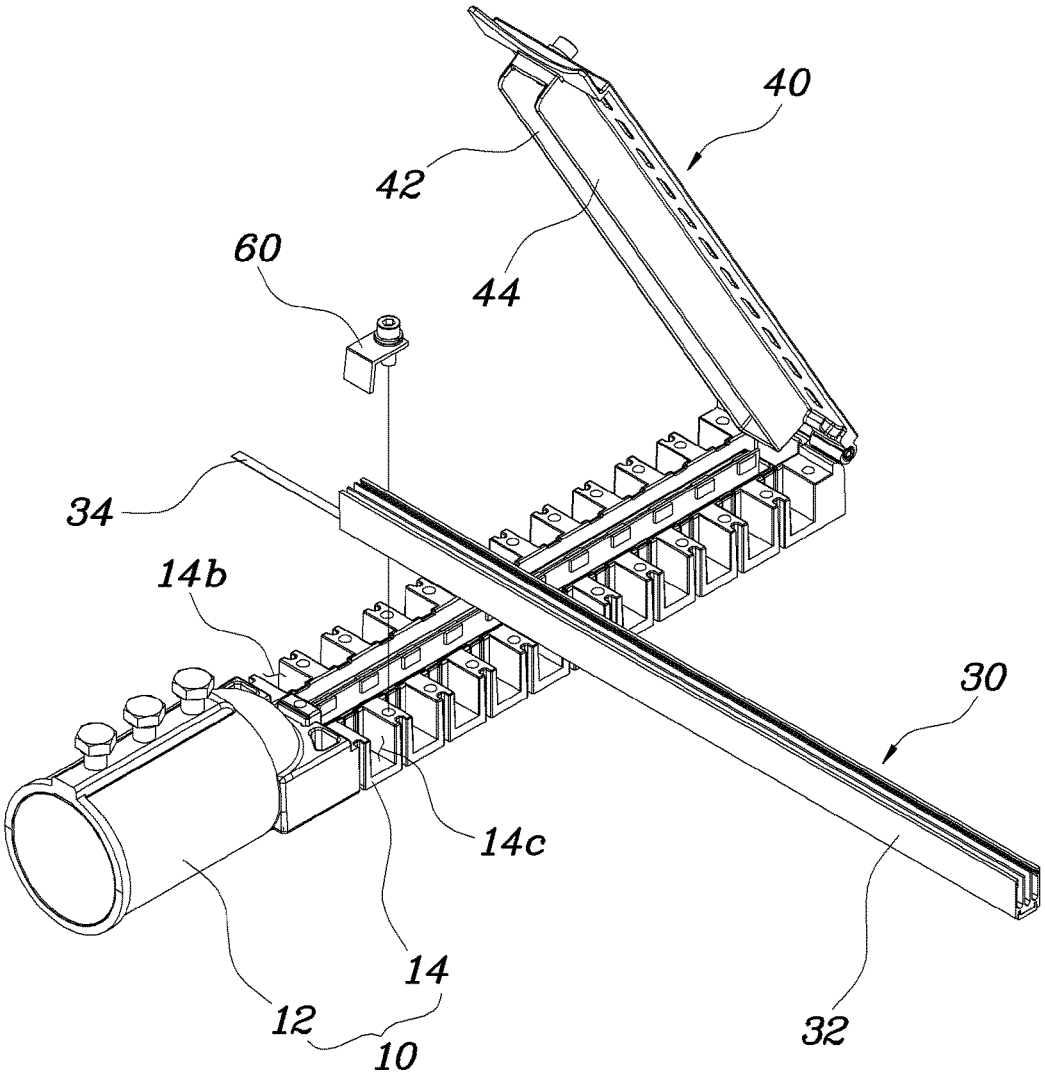

LED STREETLAMP

CROSS-REFERENCE TO RELATED APPLICATIONS

This application is a continuation of International Application No. PCT/KR2014/008275, filed on Sep. 3, 2014, which claims the benefit of Korean Application No. 10-2014-0112178, filed on Aug. 27, 2014. The disclosures of the above applications are incorporated herein by reference.

FIELD

The present disclosure relates generally to an LED streetlamp and, more particularly, to an LED streetlamp having increased heat dissipation performance.

BACKGROUND

The statements in this section merely provide background information related to the present disclosure and may not constitute prior art.

Light Emitting Diodes (LEDs) have great energy saving effect and can be quasi-permanently used. For this reason, LEDs increasingly find their application in various fields. Specifically, nowadays there is an attempt to replace conventional light sources in streetlamps with LEDs.

However, LEDs have a problem that they generate a larger amount of heat than conventional light sources. When the heat generated by LEDs is not dissipated well, the light efficiency of LEDs is deteriorated and the lifespan of LEDs is shortened.

Therefore, in streetlamps employing LEDs, a heat-dissipating plate having a considerably larger volume and size than an LED board provided with LEDs thereon is attached to the back surface of the LED board so that the heat generated by the LEDs can be released into air and thus be dissipated.

However, the heat radiated from the heat-dissipating plate stays within a casing of a streetlamp. Therefore, even with the use of the heat-dissipating plate, high heat dissipation efficiency cannot be obtained.

In order to solve this problem, a casing of a streetlamp may be provided with a vent hole for ventilation. However, when the casing is provided with a vent hole, since streetlamps are usually installed outdoors, rain water or insects are likely to intrude into the casing, thereby damaging the LED board, which results in deterioration of heat dissipation efficiency of the streetlamp.

Aside from this problem, the casing provided with a vent hole also has the following problem: air around the streetlamp is heated by the heat released from the heat-dissipating plate, and the heated air lingers within the casing and around the streetlamp. For this reason, the casing with a vent hole does not provide satisfactory heat dissipation efficiency.

Meanwhile, in conventional LED streetlamps, output varies from LED to LED, and heat-dissipating plates employed in the LED streetlamps are required to have different sizes according to the LED outputs. Therefore, it is difficult and burdensome to design heat-dissipating plates.

Korean Patent No. 10-0984768 (Sep. 27, 2010) discloses "Streetlamp Capable of Illumination Angle".

This streetlamp is intended to solve the problems with the conventional LED streetlamps described above. The streetlamp includes a lamp module including LEDs, a casing provided with at least one vent hole and coupled to the lamp module at a lower end thereof, and a cooling fan installed in the casing to purge heat generated by the LED out of the casing.

This conventional technology forms a plurality of vent holes in a casing and operates the cooling fan within the casing, thereby enabling the heat radiated from a heat-dissipating plate to be easily purged from the casing through the vent holes. This technology improves heat dissipation efficiency. In addition, this conventional technology measures an internal temperature of the casing by detecting the heat radiated from the heat-dissipating plate and operates the cooling fan and thus dissipates heat only when the measured temperature is a predetermined temperature or higher. Therefore, even when LEDs having diverse outputs are mounted in an LED streetlamp, it is not necessary to change the structure or design of the heat-dissipating plate.

However, this LED streetlamp has problems described below. Namely, this technology is not feasible in terms of costs because it requires forming a plurality of vent holes in each casing and installing cooling fans within the casings of a number of LED streetlamps and because various sensors and control instruments for selectively operating the cooling fans installed in the LED streetlamps are required. Furthermore, when the cooling fans, sensors, or control instruments malfunction, a heat dissipation effect cannot be obtained. Yet furthermore, it is impractical to individually inspect all of the accessory equipment to check for malfunctioning.

In addition, this technology is based on the premise that external air flows in the casing through the vent holes, then performs heat exchange with the heat-dissipating plate, and finally flows out of the casing through the vent holes. However, when the heat-dissipating plate is provided in a built-in form within the casing, heat exchange is limited due to a narrow space of the casing.

The foregoing is intended merely to aid in the understanding of the background of the present disclosure, and is not intended to mean that the present disclosure falls within the purview of the related art that is already known to those skilled in the art.

SUMMARY

Accordingly, the present disclosure has been made keeping in mind the above problems occurring in the prior art, and thus the present disclosure provides an LED streetlamp that does not necessarily require an additional heat-dissipating member, can reduce costs, can improve efficiency of repair and inspection work, and can improve heat dissipation performance.

Accordingly, the present disclosure provides an LED streetlamp including: a frame; a main printed circuit board (PCB) installed in the frame, extending in a longitudinal direction of the frame, and provided with a connector on a first side surface thereof; and a light emitting diode (LED) unit including a plurality of LED bars, each coupled to the frame at a first end thereof and emitting light by being powered via the main PCB, the LED bars arranged symmetrically at respective sides of the frame and arranged at regular intervals in the longitudinal direction of the frame.

The LED bar includes a heat sink, a flexible PCB that is in surface with a first surface of the heat sink and is coupled to the main PCB at a first end thereof, and a lens attached to the flexible PCB.

The first surface of the heat sink is provided with a pair of coupling recesses spaced from each other in a widthwise direction of the heat sink, a second surface of the heat sink is provided with a first heat-dissipating fin, a second heat-dissipating fin, a third heat-dissipating fin, and a fourth heat-dissipating fin arranged in this order, and the lens has an arch shape and is provided with coupling protrusions at an edge portion thereof, the coupling protrusions fitting in the coupling recesses respectively.

The frame includes: a first frame that is a hollow frame through which a power cable passes; a second frame in which the main PCB is mounted, the second frame communicating with the first frame and being open at an upper side thereof; and a main cover having a first end that is pivotally coupled to a first end of the second frame, thereby covering the upper side of the second frame to seal the second frame.

The first heat-dissipating fin and the fourth heat-dissipating fin protrude from respective side edges of the second surface in a direction perpendicular to the second surface, and the second heat-dissipating fin and the third heat-dissipating fin are arranged between the first heat-dissipating fin and the fourth heat-dissipating fin at regular intervals and protrude from the second surface in the direction perpendicular to the second surface, wherein the LED streetlamp additionally includes an end cover having a plurality of U-shaped fixing cavities that are arranged at regular intervals and into which the first to fourth heat-dissipating fins are inserted such that outer surfaces of the first heat-dissipating fin and the fourth heat-dissipating fin are in surface contact with surfaces of the fixing cavities.

A first surface of the second frame is provided with: a central recess within which the main PCB is installed; left recesses and right recesses that are symmetrically arranged at left and right sides of the central recess and into which first ends of the LED bars are inserted, the left recesses or right recesses being arranged at regular intervals in a longitudinal direction of the second frame; and mounting brackets that fix the LED bars inserted into the left recesses and right recesses.

A first insertion recess is formed between the central recess and the left recess and a second insertion recess is formed between the central recess and the right recess, wherein a bottom surface of the main cover is provided with a first plate fitting in the first insertion recess and a second plate fitting in the second insertion recess.

A space defined by an inside surface of the lens and a surface of the flexible PCB is filled with silicone According to the present disclosure, the present disclosure has advantages described below.

First, it is possible to improve heat dissipation efficiency by releasing heat generated by an LED into the air, without using an additional component part.

Second, since an LED streetlamp does not require additional various component parts for heat dissipation, the LED streetlamp can be inspected with high efficiency.

Third, it is possible to reduce costs.

Fourth, it is possible to protect an LED from moisture or water.

Fifth, LEDs can be easily replaced in a method similar to replacement of fluorescent lamps.

Sixth, it is possible to provide an LED lamp with a rating of IP68 by filling a PC-based lens with silicone.

Seventh, it is possible to provide an LED lamp that can endure strong winds and storms by optimizing arrangement of a heat-sinking member and LED bars.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a perspective view illustrating a main portion of a light emitting diode (LED) streetlamp;

FIG. 2 is a diagram illustrating an assembling process of an LED streetlamp according to the present disclosure;

FIG. 3 is a diagram sequentially illustrating a manufacturing method of an LED streetlamp according to the present disclosure;

FIG. 4 is a perspective view illustrating an assembled state of an end cover that is a main portion of the LED streetlamp according to the present disclosure;

FIG. 5 is a perspective view illustrating the LED streetlamp from which a main cover is opened;

FIG. 6 is a cross-sectional view taken along a line A-A of FIG. 1;

FIG. 7*a* is a cross-sectional view taken along a line B-B of FIG. 1;

FIG. 7*b* is a perspective view illustrating a connection relation between a main PCB and an LED bar that is a main component of the LED streetlamp of the present disclosure;

FIG. 8 is a perspective view illustrating an assembling process of the LED streetlamp according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, LED streetlamps according to various forms of the present disclosure will be described with reference to the accompanying drawings.

As shown in FIG. 1, according to the present disclosure, a light emitting diode (LED) streetlamp includes a frame 10, a main printed circuit board (PCB) 20, and an LED unit U.

The frame 10 is a skeleton to which the main PCB 20 and the LED unit U are fixed. The shape and material of the frame 10 can be diversely determined according to designer choice.

The main PCB 20 is mounted within the frame 10 used as a protective member of the LED streetlamp according to the present disclosure. The main PCB 20 is provided with a plurality of connectors 20*a*. The connector 20*a* is connected to a flexible PCB 34 of an LED bar 30, thereby transferring electric power supplied from an external power source to the LED bar 30.

The LED bar 30 is coupled to the frame 10 at a first end thereof and emits light when powered via the main PCB 20. The LED bar 30 is present in plural number. The multiple LED bars 30 are symmetrically arranged with respect to the frame 10. The LED bars 30 are arranged at regular intervals in a longitudinal direction of the frame 10. The multiple LED bars 30 constitute the LED unit U.

Taking an example in which the frame 10 is elongated in one direction, the LED bars 30 are symmetrically arranged at left and right sides of the frame 10. Furthermore, the LED bars 30 at either side of the frame 10 are arranged at regular intervals in the longitudinal direction of the frame 10. The LED unit U consists of the multiple LED bars 30 arranged in the way described above.

The LED streetlamp according to the present disclosure includes the multiple LED bars 30 that are arranged at regular intervals and are directly exposed to the air. Therefore, heat generated by the LED bars 30 during light emission can be directly released into the air because the LED bars 30 are nude-type LED lamps. Therefore, according to the present disclosure, a heat dissipation effect is improved and the lifespan of an LED streetlamp is prolonged.

In addition, since the LED bars are spaced from each other, the LED streetlamp according to the present disclosure has good ventilation performance. That is, wind can easily pass between the LED bars. Therefore, the LED streetlamp has high resistance to wind. That is, it can endure strong winds or storms.

As shown in FIGS. 3 and 4, in the LED streetlamp according to the present disclosure, the LED bar 30 includes a heat sink 32, the flexible PCB 34 that is in surface contact with the heat sink 32 and is coupled to the main PCB 20 at a first end thereof, and a plurality of lenses 36 combined with the flexible PCB 34.

The flexible PCB 34 that is attached to a surface of the heat sink 32 is connected to the main PCB 20, thereby receiving electric power, supplied from an external power source, via the main PCB 20.

The heat sink 32 in one form is made of aluminum that is a highly heat conductive material.

Hereinafter, a method for assembling the LED bar 30 will be described in brief.

First, a heat sink 32 that is a bar-like member extending in a direction is prepared, an adhesive is applied to a surface of the heat sink 32, and a flexible PCB having the same length as the heat sink 32 is pasted to the surface of the heat sink 32 via the adhesive.

After the flexible PCB 34 is pasted to the surface of the heat sink 32, bonding is performed using silicone having high thermal conductivity and adhesiveness.

After the flexible PCB 34 is bonded to the surface of the heat sink 32, a plurality of lenses 36 is mounted on the flexible PCB 34. The lenses 36 are arranged in one form at regular intervals on the flexible PCB 34. An output of the LED bar is flexibly adjusted according to the number of lenses mounted on the flexible PCB 34 in the process of manufacturing the LED streetlamp.

The lenses 36 may be filled with silicone. That is, a space defined by an inside surface of each lens 36 and the surface of the flexible PCB 34 is filled with silicone. When the space defined by the inside surface of each lens 36 and the surface of the flexible PCB 34 is vacant, moisture, rainwater, or impurities can permeate into the space, resulting in deterioration in the luminance of the LED streetlamp.

Accordingly, in one form the space is filled with silicone to provide airtight, dustproof, and waterproof effects.

A first surface of the heat sink 32 is provided with a pair of coupling grooves 32*a* spaced from each other in a widthwise direction thereof. A second surface, opposite to the first surface, of the heat sink 32 is provided with a first heat-dissipating fin 32*b*, a second heat-dissipating fin 32*c*, a third heat-dissipating fin 32*d*, and a fourth heat-dissipating fin 32*e* arranged in this order and spaced from each other in the widthwise direction.

Specifically, the first heat-dissipating fin 32*b* and the fourth heat-dissipating fin 32*e* protrude from respective side edges of the second surface of the heat sink 32 in a direction perpendicular to the second surface, and the second heat-dissipating fin 32*c* and the third heat-dissipating fin 32*d* are arranged between the first heat-dissipating fin 32*b* and the fourth heat-dissipating fin 32*e*. The first to fourth heat-dissipating fins 32*b*. 32*c*, 32*d* and 32*e* are arranged at regular intervals in the widthwise direction of the heat sink 32.

That is, the second surface of the heat sink 32 is provided with the first to fourth heat-dissipating fins 32*b*, 32*c*, 32*d* and 32*e* that protrude from the second surface in the perpendicular direction and are spaced from each other by a predetermined distance. That is, the heat sink 32 is an open type heat sink. Therefore, the heat sink 32 increases a heat dissipation effect.

The lens 36 takes an arch shape. The lens 36 is provided with coupling protrusions 36 fitting in the coupling grooves 32*a* at edge portions thereof.

The lens 36 functions as a cover. The lens 36 is made of a material that can effectively transmit light therethrough, thereby improving light efficiency of an LED. The space within the lens 36 is filled with heat-resistant, highly-transparent silicone. Therefore, the inside of the lens 36 maintains an airtight, dustproof, and waterproof state.

The lens 36 can be made of various materials. An example of the material is polycarbonate (PC). Furthermore, since the inside of the lens 36 is filled with silicone, dustproof and waterproof effects of a rating of IP68 or higher can be obtained.

In the IP code, the first digit stands for the degree of resistance to dust and the second digit stands for the degree of water resistance. The present disclosure provides a high IP rating.

On the other hand, as shown in FIG. 4, the LED streetlamp according to the present disclosure may further include an end cover 50 having a plurality of reversed U-shaped fixing cavities 50*a* into each of which the heat sink is inserted such that the first heat-dissipating fin 32*b* and the fourth heat-dissipating fin 32*e* are in surface contact with the inside surface of the fixing cavity 50*a*.

The end cover 50 collectively fixes the ends of the multiple LED bars 30 not to be displaced, thereby providing precise alignment of the LED bars 30.

As shown in FIGS. 5 and 6, the frame 10 of the LED streetlamp according to the present disclosure includes a first frame 12 and a second frame 14.

The first frame 12 is a hollow frame through which a power cable C can pass. The second frame 14 is formed to communicate with a hollow portion of the first frame 12 and an upper side of the second frame 14 is open. The main PCB 20 is mounted within the second frame 14.

The frame may additionally include a main cover 40 that can cover the upper side of the second frame 14. A first end of the main cover 40 is pivotally coupled to a first end of the second frame 14.

The first ends of the main cover 40 and the second frame 14 are coupled to each other by a hinge so that the main cover 40 can pivot to and from the second frame 14. In one form, a push type opening structure is employed. That is, the main cover 40 is opened by means of a spring pin. In order to inhibit accidental opening, second ends of main cover 40 and the second frame 14 are fixed to each other by a fixing member such as a bolt.

In addition, the second frame 14 is provided with a slot extending in a longitudinal direction of the frame to fix the main PCB 20. The main PCB 20 is vertically inserted into the slot.

A rectangular flange P is combined with the power cable C that is used to supply electric power. The flange P inhibits the power cable C from escaping from the LED streetlamp when an impact is applied to the LED streetlamp. The rectangular flange P is inserted into a gap between the main PCB 20 and the first frame 12. Thus, the flange P also functions to securely fix the main PCB 20.

All of the contact points of the main PCB 20, the flexible PCB 34, and the power cable C are in one form plated with solid gold and thus are resistant to corrosion when electric power is supplied.

As shown in FIGS. 7 and 8, a first surface of the second frame 14 is provided with a central recess 14*a* in which the main PCB 20 is installed, and left recesses 14*b* and right recesses 14*c* that are arranged at left and right sides of the central recess 14*a* and into which ends of the LED bars 30 are respectively inserted. The left recesses 14*b* or the right recesses 14*c* are arranged at regular intervals in the longitudinal direction of the second frame 14. The LED streetlamp also further includes mounting brackets 60 that respectively fix the LED bars 30 inserted in the left recesses 14*b* and the right recesses 14*c*.

The mounting brackets 60 may have an upside-down letter-L shape. Using the mounting brackets 60 and additional bolts, the LED bars 30 are fixed to the second frame 14. In this case, a spring washer, a flat washer, or the like is first put on a bolt and then the bolt is screwed.

In addition, a first insertion recess 14*d* is provided between the central recess 14*a* and the left recess 14*b* and a second insertion recess is provided between the central recess 14*a* and the right recess 14*c*. In one form, the bottom surface of the main cover 40 is provided with a first plate 42 to be inserted into the first insertion recess 14*d* and a second plate 44 to be inserted into the second insertion recess 14*e*.

Therefore, the second frame 14 is sealed by the main cover 40 and thus the second frame 14 is in a watertight state.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An LED streetlamp comprising:

a frame;

a main PCB installed in the frame, the main PCB arranged to extend in a longitudinal direction of the frame and provided with a connector at a first side surface thereof; and an LED unit including a plurality of LED bars, each LED bar coupled to the frame at a first end thereof and emitting light by being powered by the main PCB, the LED bars being symmetric to each other with respect to the frame and arranged at regular intervals in the longitudinal direction of the frame, at at least one side of the frame, wherein the LED bar includes a heat sink, a flexible PCB that is in surface contact with a first surface of the heat sink and is coupled to the main PCB at a first end thereof, and a lens attached to the flexible PCB.

2. The LED streetlamp according to claim 1, wherein the first surface of the heat sink is provided with a pair of coupling recesses spaced from each other in a widthwise direction of the heat sink, a second surface of the heat sink is provided with a first heat-dissipating fin, a second heat-dissipating fin, a third heat-dissipating fin, and a fourth heat-dissipating fin, and the lens has an arch shape and is provided with coupling protrusions at an edge portion thereof, the coupling protrusions fitting in the coupling recesses respectively.

3. The LED streetlamp according to claim 1, wherein the frame includes: a hollow first frame; a second frame in which the main PCB is mounted, the second frame communicating with the first frame and being open at an upper side thereof; and a main cover having a first end that is pivotally coupled to a first end of the second frame, thereby covering the upper side of the second frame to seal the second frame.

4. The LED streetlamp according to claim 2, wherein the first heat-dissipating fin and the fourth heat-dissipating fin protrude from respective side edges of the second surface in a direction perpendicular to the second surface, and the second heat-dissipating fin and the third heat-dissipating fin are arranged between the first heat-dissipating fin and the fourth heat-dissipating fin at regular intervals and protrude from the second surface in the direction perpendicular to the second surface, and wherein the LED streetlamp further includes an end cover having a plurality of U-shaped fixing cavities that are arranged at regular intervals and into which the first to fourth heat-dissipating fins are inserted such that outer surfaces of the first heat-dissipating fin and the fourth heat-dissipating fin are in surface contact with surfaces of the U-shaped fixing cavities.

5. The LED streetlamp according to claim 2, wherein a space defined by an inside surface of the lens and a surface of the flexible PCB is filled with silicone.

6. The LED streetlamp according to claim 3, wherein a first surface of the second frame is provided with: a central recess within which the main PCB is installed; left recesses and right recesses that are symmetrically arranged at left and right sides of the central recess and into which first ends of the LED bars are inserted, the left recesses or right recesses being arranged at regular intervals in a longitudinal direction of the second frame; and mounting brackets that fix the LED bars inserted into the left recesses and right recesses.

7. The LED streetlamp according to claim 6, wherein a first insertion recess is formed between the central recess and the left recess and a second insertion recess is formed between the central recess and the right recess, and wherein a bottom surface of the main cover is provided with a first plate fitting in the first insertion recess and a second plate fitting in the second insertion recess.

* * * * *